US007852313B2

(12) United States Patent
Sekiguchi

(10) Patent No.: US 7,852,313 B2
(45) Date of Patent: Dec. 14, 2010

(54) DISPLAY DEVICE

(75) Inventor: Nobutoshi Sekiguchi, Saitama (JP)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 785 days.

(21) Appl. No.: 11/405,883

(22) Filed: Apr. 18, 2006

(65) Prior Publication Data

US 2006/0232545 A1 Oct. 19, 2006

(30) Foreign Application Priority Data

Apr. 18, 2005 (JP) ..... 2005-119215

(51) Int. Cl.
*G09G 3/36* (2006.01)

(52) U.S. Cl. ..... 345/102; 345/74.1; 345/94; 359/783; 349/106

(58) Field of Classification Search ..... 345/74.1, 345/97, 102; 359/783; 250/208.1; 349/106
See application file for complete search history.

(56) References Cited

U.S. PATENT DOCUMENTS

| | | | | |
|---|---|---|---|---|
| 4,958,915 | A * | 9/1990 | Okada et al. | 345/97 |
| 5,838,288 | A * | 11/1998 | Lambert et al. | 345/74.1 |
| 6,252,218 | B1 * | 6/2001 | Chou | 250/208.1 |
| 7,142,179 | B2 * | 11/2006 | Miller et al. | 345/76 |
| 2002/0075224 | A1 | 6/2002 | Son | |
| 2003/0011559 | A1 * | 1/2003 | Adachi et al. | 345/102 |
| 2004/0239839 | A1 | 12/2004 | Hong | |
| 2004/0257677 | A1 * | 12/2004 | Matsusaka | 359/783 |
| 2006/0007105 | A1 * | 1/2006 | Chen et al. | 345/102 |
| 2006/0077122 | A1 * | 4/2006 | Gally et al. | 345/32 |
| 2007/0030241 | A1 * | 2/2007 | Adachi et al. | 345/102 |

FOREIGN PATENT DOCUMENTS

| | | |
|---|---|---|
| JP | 2001-92414 | 4/2001 |
| JP | 2001-332764 | 11/2001 |
| JP | 2002-287112 | 10/2002 |
| JP | 2002-318564 | 10/2002 |
| JP | 2003-280614 | 10/2003 |
| WO | WO-2004/032523 | 4/2004 |

* cited by examiner

*Primary Examiner*—Amare Mengistu
*Assistant Examiner*—Premal Patel

(57) ABSTRACT

A display device comprises a light source consisting of three emission elements, each of which emits light of different wavelength regions corresponding to the respective colors of red, green and blue, and a display module consisting of a display part wherein each pixel has two types of color filters that transmit red and green light and green and blue light, respectively. One frame of video signals is split during display to become two subframes and it is possible to alternately emit for each subframe green light, which is transmitted through both color filters, and red and blue light, each of which is transmitted through only one filter.

13 Claims, 4 Drawing Sheets

(a)

(b)

(c)

(d)

(a)

(b)

(a)

(b)

(c)

DISPLAY DEVICE

FIELD OF THE INVENTION

The present invention relates to a liquid crystal display device for color display that is widely used in televisions, personal computer monitors, laptop monitors, mobile telephones, game players, and the like, and in particular, relates to a display device having a light source that is capable of independently controlling R (red), G (green), and blue (blue) emission.

DISCUSSION OF THE BACKGROUND ART

Liquid crystal display devices normally consist of a light source that is placed at the back surface of a liquid crystal panel. Conventional light sources often have a cold cathode ray tube or other lamp as the emission means, but light sources that use a light-emitting diode or other semiconductor element as the light-emitting means are now used for practical purposes (for instance, refer to JP Unexamined Patent Application (Kokai) 2001-92,414, and JP Unexamined Patent Application (Kokai) 2001-332,764).

On the other hand, a typical color display system for liquid crystal display devices is a field sequential display system (refer to JP Unexamined Patent Application (Kokai) 2002-287,112 and JP Unexamined Patent Application (Kokai) 2002-318,564. Colors are displayed by such a system as a result of light being radiated by emission means corresponding to each color of R (red), G (green), and B (blue) and, in synchronization with this radiation, an image corresponding to the radiated colors is displayed on a liquid crystal panel. For instance, a frame period, which is the smallest unit necessary for displaying one image, is split into three subfields and emission is performed in the order of R→G→B in accordance with the respective subfield. As a result, an observer can watch a moving picture on the display screen by color display.

The intention of using a semiconductor element such as a light-emitting diode as the emission means is to reduce power consumption of the display device and to minimize the amount of heat generated. However, field sequential systems are known to pose a problem in terms of a color disruption that is attributed to mistiming of emissions, and the like. A system of sequential repetition has been proposed in order to solve this problem whereby the frame period is further subdivided, for instance, divided into six subfields, and one of the three primary colors of R, G, and B is selected and radiated (refer to JP Unexamined Patent Application (Kokai) 2003-280,614).

Nevertheless, there is a need for further modification because there is no effective means for the efficient use of light output from an emission means in order to lower the energy consumption while maintaining a relatively strong brightness. For instance, the display switching speed of the liquid crystal display is not fast enough to follow the switching between the emission means when the above-mentioned subfield is further divided into six fields; therefore, it is very difficult to realize a practical display device.

Thus, an object of the present invention is to provide an improved display device with which the above-mentioned problems can be solved.

SUMMARY OF THE INVENTION

The present invention provides a display device, characterized in having three types of emission elements, each of which is separately controlled and emits light of a different wavelength corresponding to red, green and blue, and, for the emission wavelengths of said three emission elements, there are two color filters for the transmission of light in the red and green wavelength regions and of light in the green and blue wavelength regions, respectively; wherein one frame of video signals is split into two subframes, and it is possible to alternately emit for each frame light of the green wavelength region that is transmitted through both of said two color filters and light of the red and blue wavelength regions that is transmitted through only one of said filters.

Three types of emission elements can also serve as the emission elements for emitting each color of light. The display device comprises a liquid crystal panel and is obtained by setting up two color filters corresponding to each pixel on the liquid crystal panel. Moreover, the display device can also comprise drive means for driving the liquid crystal panel and a control device for controlling the emission from the three types of emission elements based on the output signals from the drive means.

Typically, the two types of color filters corresponding to the pixels are set so that the surface area ratio of the red, green, and blue emissions is 1:2:1 within one pixel, but it is also possible to set the surface area to another ratio depending on the emission intensity of the light-emitting diodes that form the emission means, and the like. Moreover, when the emission elements are formed from light-emitting diodes or other semiconductor elements, the emission elements can be extinguished when the subframe is completed by a high-frequency modulation of the emission signals.

A bright display is realized with low energy consumption and minimal generation of heat because there is a relative increase in the luminous energy of each light used in the display. In particular, it becomes possible to greatly reduce the number of light-emitting diodes for green emission by increasing the green luminous energy, and this leads to a reduction in cost, a reduction in power consumption, and a reduction in the amount of heat generated. Moreover, it becomes possible to reduce the drive current of the red, green, and blue light-emitting diodes by increasing the luminous energy of each of the diodes, and power consumption and the amount of heat generated can be reduced while keeping the illumination constant. Each pixel can be shared by two colors and the resolution of at least green images can therefore be brought to twice the resolution of the red and blue images.

DETAILED DESCRIPTION OF THE PREFERRED EMBODIMENT

Figure 1:
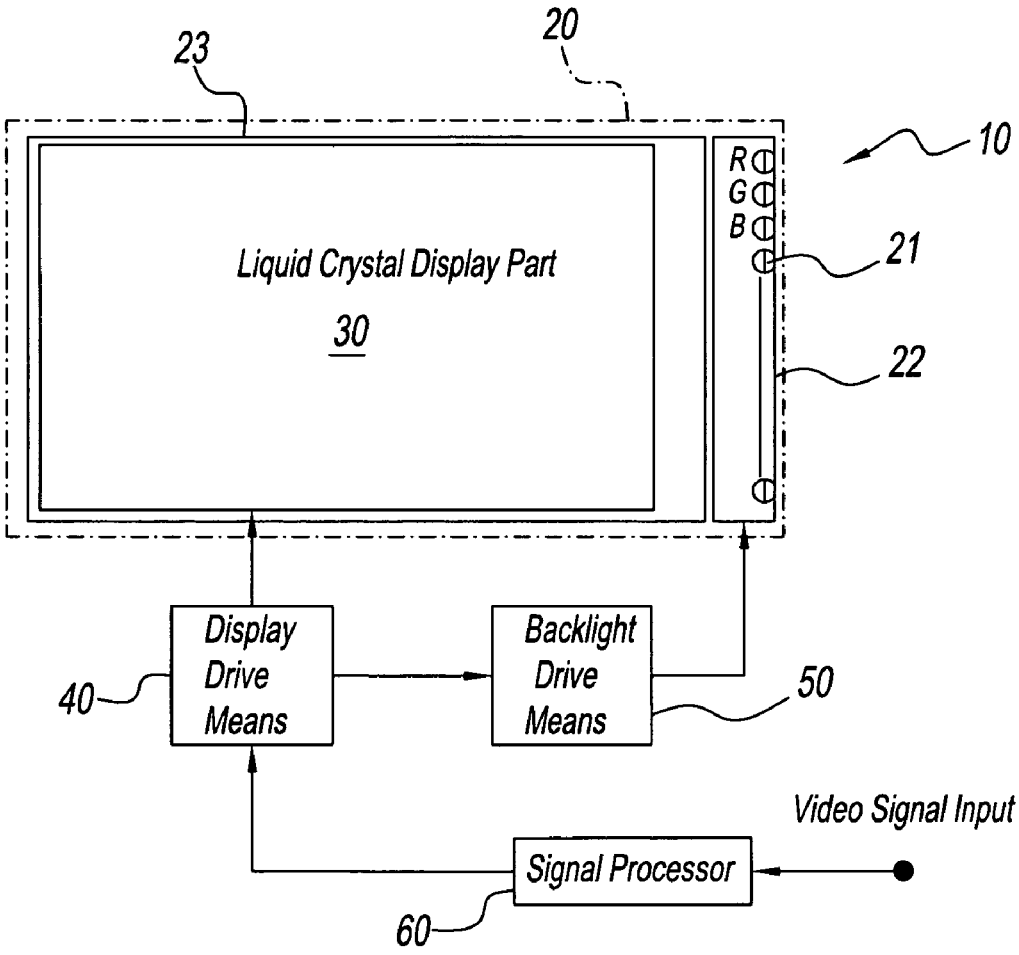
FIG. 1 is a drawing showing each structural element of the display device of the present invention.

A preferred embodiment of the display device of the present invention will now be described in further detail while referring to the drawings.

FIG. 1 is a drawing showing each structural element of the display device of the present invention. A display device 10 of the present invention comprises a display means 20 consisting of a liquid display module 23 and a backlight source 22 that supplies backlight from behind the module. Although not illustrated, there is usually a light guide on the back of liquid display module 23, and light from light source 22 is radiated onto this light guide. The light guide feeds backlight from behind liquid crystal display module 23 over the entire surface of a display part 30. Liquid crystal display module 23 is driven by a drive means 40 and the screen thereof is displayed. Drive means 40 is separate from display means 20 in FIG. 1, but it can also be a single cohesive unit with liquid crystal display module 23 as a part of display means 20.

The emission device or light source 22 of the present embodiment comprises multiple light-emitting diodes 21. As shown in the drawing, multiple light-emitting diodes 21 are positioned in emission device 22 such that they form an array. Diodes that emit light of multiple wavelengths are used as the multiple light-emitting diodes 21. The three colors of R (red), G (green), and B (blue) are normally used for the backlight, and light from these single colors or compound colors is supplied to the light guide.

The multiple light-emitting diodes 21 of light source 22 are turned on and off and the emission intensity thereof is controlled by a backlight drive means 50. In this case, backlight drive means 50 can control the emission of light-emitting diodes 21 by multiple methods. For instance, backlight drive means 50 can control the multiple light-emitting diodes individually; it can control each light-emitting diode 21 that emits the same color; it can control each group of diodes arranged in a row; or it can control all of the diodes at once. Backlight drive means 50 in FIG. 1 is separate from display means 20, but it can also be a part of display means 20.

As shown in FIG. 1, the video signals that have been input to display device 10 are processed by a signal processing means 60. The frame time, which is discussed later, is determined during this signal processing. The signals that have been processed by signal processing means 60 are supplied to display drive means 40. Display drive means 40 supplies liquid crystal drive signals for controlling the liquid crystal display to liquid crystal display module 23 as previously described, and also feeds predetermined control signals to backlight drive means 50 such that the backlight can be driven in synchronization with the liquid crystal display.

Figure 2:
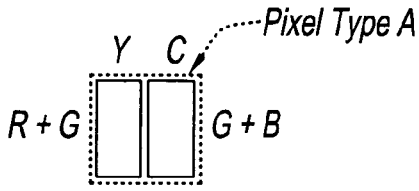
FIG. 2 is a schematic drawing showing the concept of the display system of the display device of the present invention. Here, (a) is a drawing showing one pixel of the display device, (b) is a drawing showing the operation thereof, (c) is a drawing showing the color or wavelength of the light transmitted by the filters in the pixels upon operation, and (d) is a drawing showing a modified version of the pixel.
Figure 2:
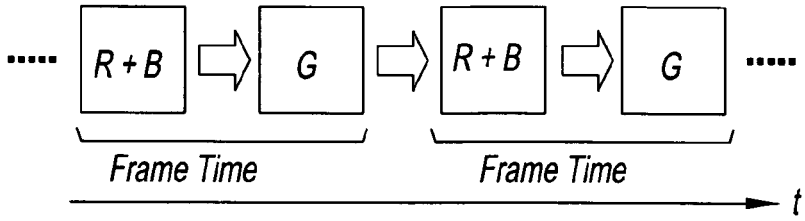
Figure 2:
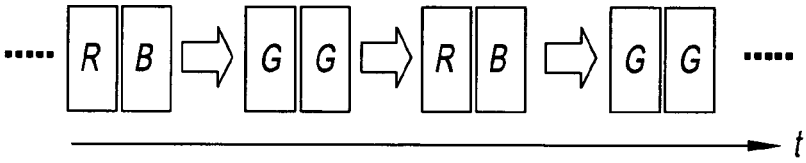
Figure 2:
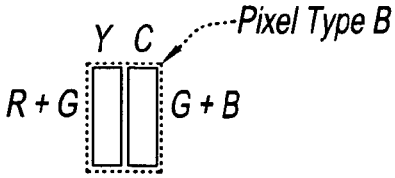

FIG. 2 is a schematic depiction showing the concept of the display system for the display device of the present invention. Here, (a) is a drawing showing one pixel of the display device, (b) is a drawing showing the concept behind the operation of the pixel, (c) is a drawing showing the color or wavelength of the light that is transmitted through the filter of the pixels upon operation, and (d) shows another version of the pixel.

The pixel unit of the pixel in FIG. 2(*a*) (represented as type A for convenience) takes on the shape of a virtual square. These pixel units are arranged over the entire surface of display part 30, for instance, in matrix form. The pixels comprise two filters, a first color filter and a second color filter. This arrangement is different from conventional products of the same type in that usually one pixel is divided into three subgroups and the three subpixels are disposed such that red, green, and blue color filters are attached to each subpixel. By means of the present invention, the two types of filters are alternately disposed spatially such that they constitute one pixel to form a color filter mosaic.

The first color filter transmits light in the red and green wavelength regions, and light that appears to be yellow is transmitted through the first color filter when a white light source is input. Consequently, the first color filter is called a yellow filter (or Y filter). The second color filter transmits light in the emission wavelength regions of green and blue. Light that appears cyan in color is transmitted through this filter in response to input of a white light source. Consequently, it is called a cyan filter (or C filter). These filters are made, for instance, from an organic material, and they can be formed by printing along the surface of the glass substrate of the liquid crystal display device.

The display effect of this pixel is shown in FIG. 2(*b*). That is, the light-emitting diodes interchangeably provide the color filter mosaic with two types of illumination. The two types of illuminate are simultaneous illumination with red (R) and blue (B), and illumination with green (G) alone. As a result, light from the red and blue light-emitting diodes is transmitted through the filter during the first half of the frame time, while only light from the green light-emitting diode is transmitted from the same pixel through the filter during the second half of the frame time. The next frame time starts immediately after one frame time is completed in order to display the pixel.

Light that is transmitted through each filter during the first and second halves of the frame time is shown in FIG. 2(C). That is, light in the red wavelength region is transmitted from the yellow filter on the left side of the drawing and light in the blue wavelength region is transmitted from the cyan filter on the right side of the drawing during the first half of each frame. On the other hand, light in the green wavelength region is transmitted from both filters during the last half of the frame period. Consequently, full-color display becomes possible as a result of establishing continuous frame times and performing these two types of illuminations sequentially for each frame. The emission colors during the first and last halves of the frame time can be reversed from blue and red to green.

In the past, red, green, and blue videos corresponding to each of the three subpixels forming one pixel were transferred to the respective pixel. In contrast to this, the horizontal resolution of the red, green, and blue images of the present embodiment of the present invention can be pre-set, for instance, at 1.5-times, 3-times, and 1.5-times that of the prior art, respectively. The corresponding red image must be transferred to the pixel with the yellow filter, and the corresponding blue image must be transferred to the pixel with the cyan filter for red and blue illumination. Moreover, the corresponding green video signals must be transferred to all pixels for green illumination. Full-color video display can be obtained by performing this type of procedure for each frame.

With respect to the surface area occupied by the colors at this time, red and blue will each account for ½ of the total surface area and green will account for the total surface area. In the past, each color of red, green, and blue accounted for ⅓ of the total surface area and therefore, in this case the red and blue surface area is increased by 1.5-times, and the green surface area is increased by 3-times. On the other hand, spatially each color accounts for only ½ of the surface area. However, the drive current of the light-emitting diode can be increased by this increment by curtailing the display time.

Therefore, theoretically, it is possible to obtain a luminous energy output that is 1.5-times greater for red and blue and 3-times greater for green.

On the other hand, there are restrictions to the current that can be applied to the light-emitting diode, and the luminous energy output is actually less than the above-mentioned output when the current that is applied is relatively large because the linear relationship between the luminous energy output from the light-emitting diode and the input current is compromised. An increase in luminous energy that is as much as 1.8-times greater for red and blue and 1.67-times greater for green is intended; therefore, when compared to the prior art, an increase in output of as much as 1.35-times for red and blue and 2.5-times for green is expected. Horizontal resolution in the green wavelength region, wherein human vision is at its most sensitive, is twice that of the prior art, and perception of high definition is also improved.

FIG. 2(*d*) shows a modified example of the pixel (Type B for convenience). This pixel is the same as the above-mentioned pixel (Type A) in that there is a row of yellow filters and cyan filters, but it differs from Type A in that the overall shape of the pixel unit is not a square but rather a lengthwise rectangle. It is possible to obtain a display device of higher precision than conventional display devices by optimizing the arrangement of the pixel units.

The present invention provides a display with which improved resolution and an increase in luminous energy can be realized by alternating between red and blue illumination and green illumination using a structure wherein each pixel unit comprises a yellow filter and a cyan filter, as described above, but the present invention also can improve the saturation of each color by an appropriate selection of the filter material.

That is, the color filter mosaic is used for mixed illumination with blue and red or single color illumination with green by the display device of the present invention. Consequently, spectrum overlap by the light sources, which becomes a source of a reduction in saturation in the prior art, can be eliminated by optimizing the filter material and selecting the yellow filter so that insofar as possible, it does not introduce blue emission and by selecting the cyan filter so that insofar as possible, it does not introduce red emission.

Figure 3:
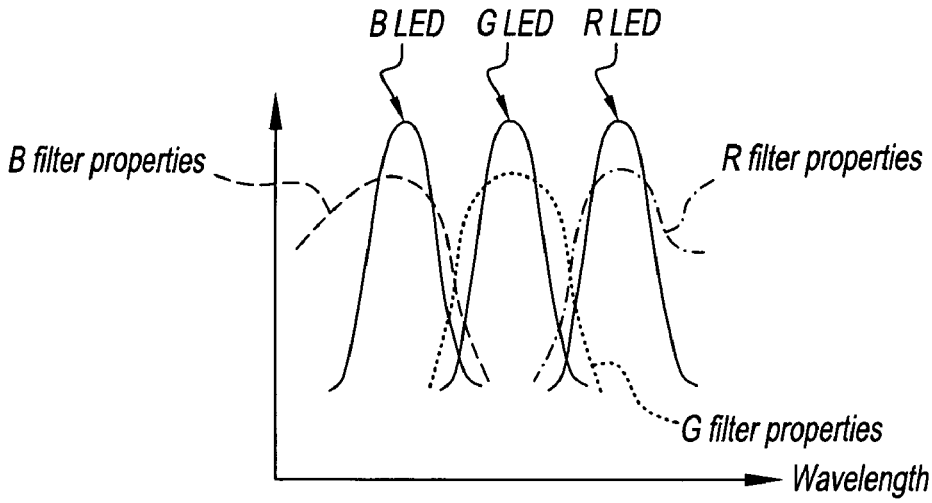
FIG. 3 is a drawing showing the output of light by a display device that uses three conventional R, G and B filters. Here, (a) is a drawing showing the emission spectrum waveform of each of the light-emitting diodes and the light transmission properties of each filter, and (b) is a drawing showing the spectrum waveform of light that is transmitted by the filters.
Figure 3:
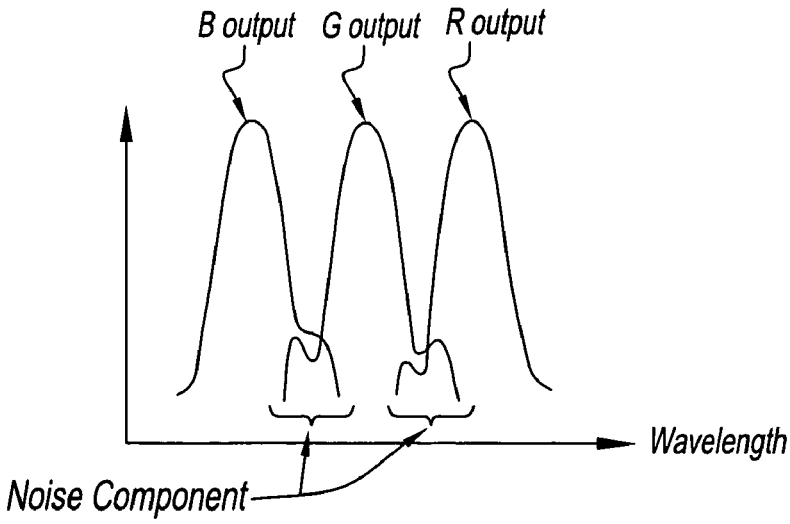
Figure 4:
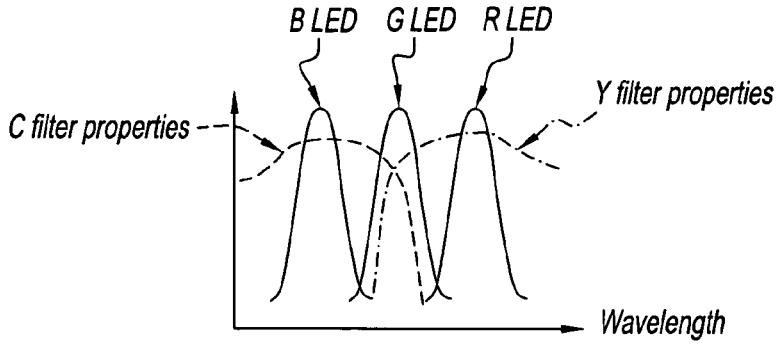
FIG. 4 is a drawing showing the output of light by a display device of the present invention that uses two types of filter, a Y filter and a C filter. Here, (a) is a drawing showing the emission spectrum waveform of each light-emitting diode and the light transmission properties of each filter, and (b) is a drawing showing the spectrum waveform of light that is transmitted by the filters.
Figure 4:
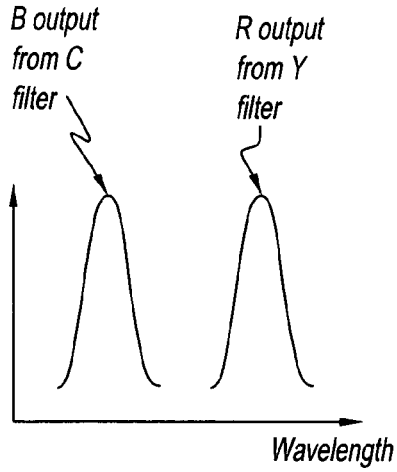
Figure 4:
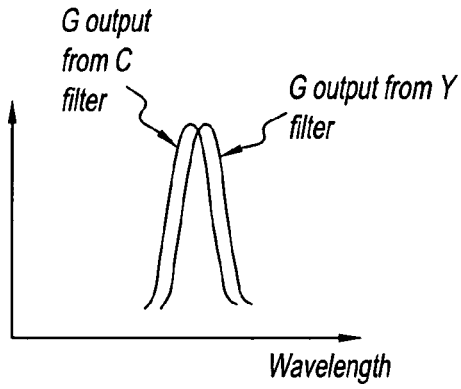

FIGS. 3 and 4 are drawings that explain the mode of operation and effect of the present invention. FIG. 3 is a figure showing the output of light from a display device that uses the three conventional R, G, and B filters. Here, (a) shows the emission spectrum waveform of each light-emitting diode and the light transmission properties of each filter, and (b) is a drawing that shows the spectrum waveform of light that is transmitted by the filters. FIG. 4 is a drawing showing the output of light from a display device that uses the two types of filters denoted the Y filter and the C filter. Here, (a) shows the emission spectrum waveform of each light-emitting diode and the light transmission properties of both filters, and (b) is a drawing showing the spectrum waveform of light that is transmitted by the filters.

By means of the conventional display device in FIG. 3, three types of filters are used in accordance with the light sources, which are a blue light-emitting diode (B-LED), a green light-emitting diode (G-LED), and a red light-emitting diode (R-LED). The emission wavelength from each of the light-emitting diodes here is as wide as shown in the drawings, and as a result, overlapping is seen at the "trough" of the spectrum waveform. On the other hand, each of the R, G, and B filters is set so that it will transmit light of a wider wavelength region that the emission wavelength of each light-emitting diode, as shown in the drawing, which is intended to guarantee sufficient brightness. As a result, each of the R, G, and B filters also transmits a part of the light output from light-emitting diodes having adjacent wavelength properties, and this becomes a factor in the generation of a noise component in the transmitted light, that is, the output light, and causes a reduction in saturation, as shown in FIG. 3(*b*).

In contrast to this, green and a combination of blue and red are individually emitted by the display device of the present invention shown in FIG. 4, as previously described. The Y filter and the C filter allow for transmission of the light over the entire R-LED emission wavelength; light the primary component of which tends toward the longer wavelength of the G-LED emission wavelength; and light the primary component of which tends toward the shorter wavelength of the B-LED emission wavelength. As a result, a noise component due to overlapping of spectra is not generated with blue and red illumination during one frame time, as shown in FIG. 4(*b*), and only the peaks, which are virtually in the green wavelength region, overlap during green illumination, as shown in FIG. 4(*c*). Consequently, the present invention has an advantage in that there is none of the reduction in saturation that becomes a problem with the prior art.

The above has been a detailed description of the display device that is a preferred embodiment of the present invention, but it goes without saying that this is merely an example and various modifications and changes by persons skilled in the art are possible.

For instance, when a light-emitting diode element is used as the light source, it is possible to extinguish the illumination light for each subframe by a high-frequency modulation of the emission from the element in question and thereby minimize the effect of afterglow of the liquid crystal device and improve the image quality of the moving picture. Moreover, it is also possible to use a revised version of dark gradation such as dynamic contrast whereby the brightness of the illumination light is dynamically modulated in accordance with input signals so that the liquid crystal device is always driven by full gradation.

What is claimed is:

1. A display device comprising:

a backlight comprising a red light emission element, a blue light emission element and a green light emission element;

a liquid crystal panel configured as a plurality of pixels, each of said plurality of pixels comprising a first color filter and a second color filter;

wherein said first color filter allows transmission therethrough of red light and green light, but not blue light; and wherein said second color filter allows transmission therethrough of green light and blue light, but not red light;

a signal processor adapted to process each frame of a video signal input into a first subframe and a second subframe;

a backlight controller adapted to:

activate the red light emission element and the blue light emission element but not the green light emission element during each first subframe; and activate the green light emission element but not the red light emission element or the blue light emission element during each second subframe.

2. The display device of claim 1 and further wherein each of said pixels emits red light and blue light during the first subframe and green light during the second subframe.

3. The display device of claim 1 and further wherein said first color filter emits red light during the first subframe and green light during the second subframe.

4. The display device of claim 1 and further wherein said second color filter emits blue light during the first subframe and green light during the second subframe.

5. The display device of claim 1 and further wherein the red light emission element, the blue light emission element and the green light emission element comprise light-emitting diode elements.

6. The display device of claim 5 and further wherein said light-emitting diode elements are high-frequency modulated and extinguished after each subframe.

7. The display device of claim 1 and further wherein the surface area ratio of red light, green light, and blue light emission is 1:2:1 within each of said plurality of pixels.

8. The display device of claim 7 and further wherein the area of each of said plurality of pixels produces virtually a lengthwise rectangle.

9. In a display device comprising a plurality of pixels, a method comprising:

processing each frame of a video signal input to said display device into a first subframe and a second subframe;

wherein, said display device comprises a red light emission element, a blue light emission element and a green light emission element;

wherein, said display device further comprises a first color filter and a second color filter associated with each of said plurality of pixels;

during each first subframe:

activating the red light emission element and the blue light emission element but not the green light emission element in order to illuminate a first side of said first color filter and a first side of said second color filter with both red light and blue light; and emitting red light from a second side of said first color filter and blue light from a second side of said second color filter;

during each second subframe:

activating the green light emission element but not the red light emission element or the blue light emission element in order to illuminate the first side of said first color filter and the first side of said second color filter with green light; and emitting green light from the second side of said first color filter and from the second side of the second color filter.

10. The method of claim 9 and further wherein the red light emission element, the blue light emission element and the green light emission element comprise light-emitting diode elements.

11. The method of claim 10 and further wherein said light-emitting diode elements are high-frequency modulated and extinguished after each subframe.

12. The method of claim 9 and further wherein the surface area ratio of red light, green light, and blue light emission is 1:2:1 within each of said plurality of pixels.

13. The method of claim 12 and further wherein the area of each of said plurality of pixels produces virtually a lengthwise rectangle.

* * * * *